US006223547B1

(12) United States Patent
da Silva et al.

(10) Patent No.: US 6,223,547 B1
(45) Date of Patent: May 1, 2001

(54) AIR FILTER GUIDES FOR AN AIR CONDITIONER

(75) Inventors: Regis Batista da Silva, Sao Leopoldo; Paulo Augusto Lisboa Ramos, Morada de Esteio, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/367,586

(22) PCT Filed: Dec. 30, 1997

(86) PCT No.: PCT/BR97/00077

§ 371 Date: Aug. 17, 1999

§ 102(e) Date: Aug. 17, 1999

(87) PCT Pub. No.: WO99/35451

PCT Pub. Date: Jul. 15, 1999

(51) Int. Cl.[7] ..... F25D 23/12
(52) U.S. Cl. ..... 62/262
(58) Field of Search ..... 62/262, 315, 317

(56) References Cited

U.S. PATENT DOCUMENTS 5,065,597 11/1991 Farfaglia et al. .
5,379,609 1/1995 Matsumoto et al. ..... 62/262
5,679,121 10/1997 Kim ..... 55/481

FOREIGN PATENT DOCUMENTS 59-027138 2/1984 (JP) .
59-183228 10/1984 (JP) .

*Primary Examiner*—William Doerrler
*Assistant Examiner*—Melvin Jones

(57) ABSTRACT

According to the present invention, a filter guide structure is provided for an air conditioner of the type having an indoor section which includes a housing having an evaporator coil. The evaporator has fins on its front surface and is mounted in a substantially vertical orientation. An indoor grill is adapted to be mounted to the housing in spaced relation to the evaporator coil. The grill includes a front wall having a return air opening to admit return air to be conditioned into the evaporator coil. The front wall has an elongated opening adjacent to an edge thereof to receive the filter for insertion and removal of the filter into the space between the indoor grill and the evaporator coil. The filter includes a rectangular frame having a leading edge and a trailing edge and laterally spaced edges interconnecting the leading and trailing edges. The filter guide structure receives the laterally spaced edges of the filter after the leading edge has passed through the elongated opening and slideably guides the filter along a path which prevents contact of the filter with the fins of the evaporator coil.

2 Claims, 7 Drawing Sheets

AIR FILTER GUIDES FOR AN AIR CONDITIONER

TECHNICAL FIELD

The present invention relates to air conditioners and, more particularly, to an arrangement for facilitating installation of a filter in the indoor grill of a room air conditioner.

BACKGROUND ART

Room type air conditioners typically have an indoor section and an outdoor section. The indoor section is responsible for cooling and dehumidifying the indoor room a while the outdoor section is responsible for exhausting heat into the outdoor environment. The indoor and outdoor sections each have a heat exchanger coil and a fan, and each has a return air opening and a discharge opening. A grill structure is normally installed over each section to prevent the entry of foreign objects, while allowing the free flow of air to and from the sections as well as for aesthetic consideration.

It is common practice to have associated with the indoor grill structure a filter element, through which the indoor air passing to the indoor coil must pass. Such a filter is designed to remove substantially smaller contaminants from the air than the indoor grill. Quite often the indoor grill must be removed from the air conditioner in order to gain access to the filter. Other air conditioners are known, which have a rectangularly shaped reusable filter which slides into a slot oriented above the inlet grill such that the filter may be installed or withdrawn from a location behind the grill and in front of the evaporator coil by vertically displacing the filter within the slot.

It is deemed desirable to have a filter assembly which easily slides into a slot provided in the indoor grill. It is also desirable to prevent the filter assembly from contacting and possibly damaging the fragile heat exchange fins of the evaporator coil as the filter is installed or removed from its mounting in an indoor grill.

DISCLOSURE OF THE INVENTION

According to the present invention, a filter guide structure is provided for an air conditioner of the type having an indoor section which includes a housing having an evaporator coil. The evaporator has fins on its front surface and is mounted in a substantially vertical orientation. An indoor grill is adapted to be mounted to the housing in spaced relation to the evaporator coil. The grill includes a front wall having a return air opening to admit return air to be conditioned into the evaporator coil. The front wall has an elongated opening adjacent to an edge thereof to receive the filter for insertion and removal of the filter into the space between the indoor grill and the evaporator coil. The filter includes a rectangular frame having a leading edge and a trailing edge and laterally spaced edges interconnecting the leading and trailing edges. The filter guide structure receives the laterally spaced edges of the filter after the leading edge has passed through the elongated opening and slideably guides the filter along a path which prevents contact of the filter with the fins of the evaporator coil.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
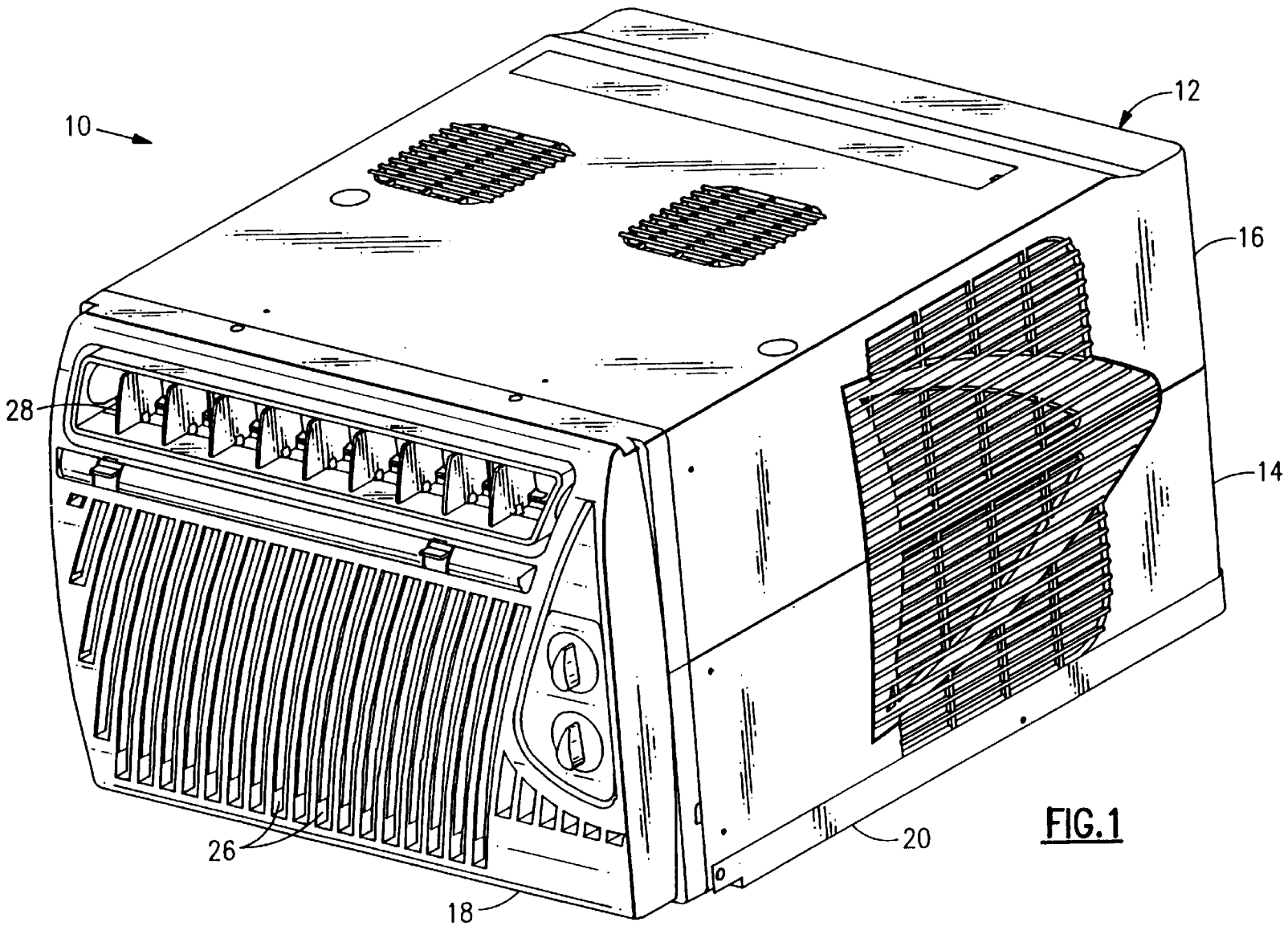
FIG. 1 is a perspective view of a room air conditioner which embodies the features of this invention.

With reference initially to FIG. 1, a room air conditioner 10 includes a substantially rectangular housing 12 which includes a lower housing section 14, an upper housing section 16, and an indoor grill section 18. The lower housing section 14 is mounted in a metal basepan 20, and the entire room air conditioner is adapted to be positioned in a rectangular opening in an exterior wall or on a windowsill in a room where cooling is desired, with the indoor grill section 18 facing into the room as is conventional.

Figure 2:
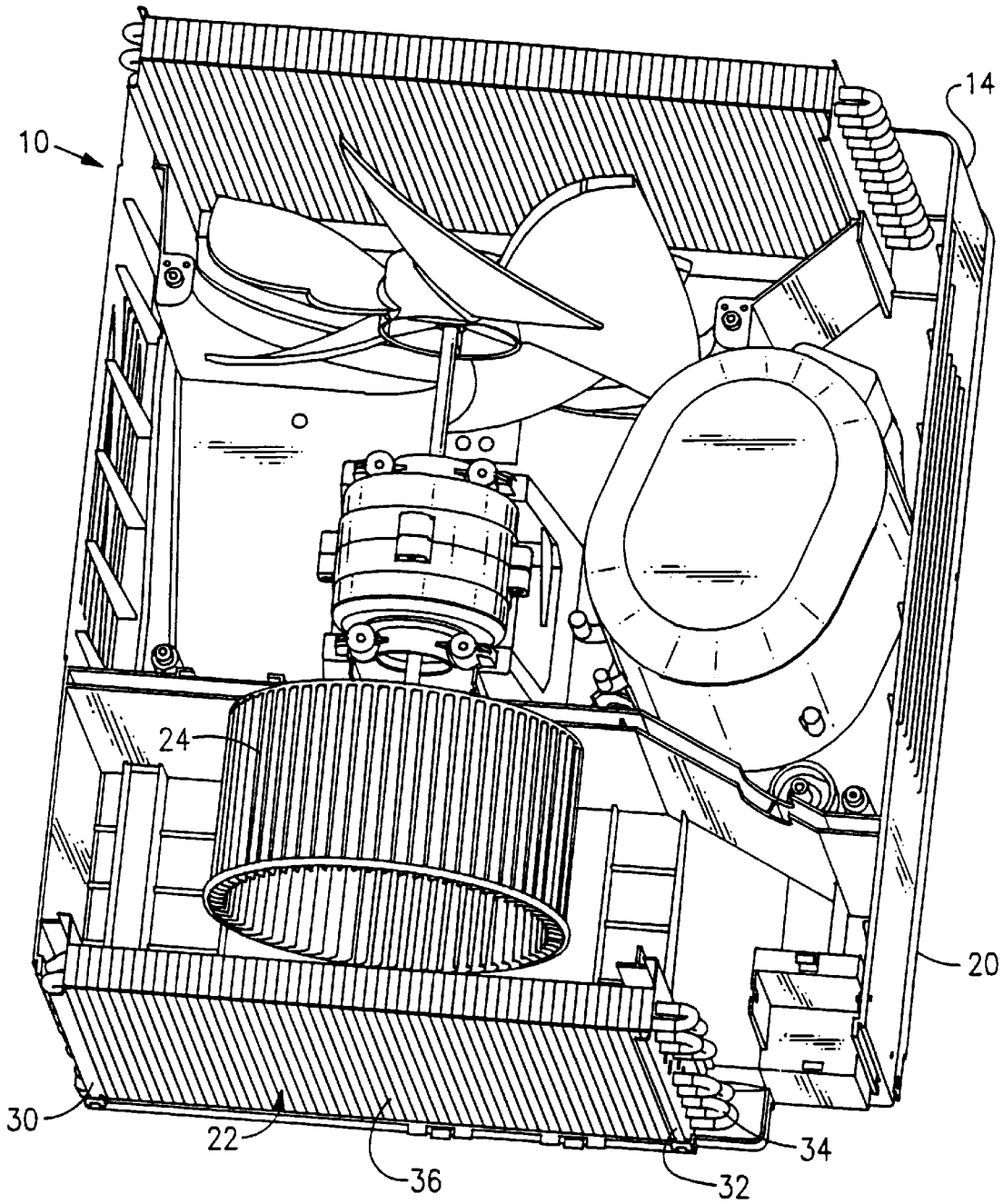
FIG. 2 is a perspective top view of a room air conditioner of the type shown in FIG. 1 with the upper cover and front grill removed therefrom.

FIG. 2 illustrates the air conditioner 10 with the upper housing 16 and the indoor grill section 18 removed. Again, as is conventional, the unit comprises an indoor refrigerant to air heat exchanger 22 (hereinafter "evaporator coil") and an inside fan or evaporator fan 24. Air from the space to be conditioned by the system is drawn by action of the evaporator fan 24, through inlet louvers 26 formed in the indoor grill section 18, through a filter element 21 (to be described in detail hereinbelow) and is directed through the evaporator coil 22 where the air is cooled, and then directed back into the space to be cooled through an indoor conditioned air discharge assembly forming part of the grill 18.

Other components of the air conditioner forming the outside or condensing unit of the air conditioning unit are not necessary to an understanding of the present invention and will not be described herein.

Looking now at FIG. 2, it will be noted that the evaporator coil 22 includes a left-hand tube sheet 30 and right-hand tube sheet 32 which extend vertically at opposite ends of the evaporator coil 22. As is conventional, several rows of heat exchanger tubes 34 interconnected by hairpin turn ends extend between the tube sheets to define a continuous flow path for refrigerant therethrough. A plurality of vertically extending heat exchange fins are carried by the tubes and extend substantially vertically and parallel to the tube sheets 30 and 32.

Figure 3:
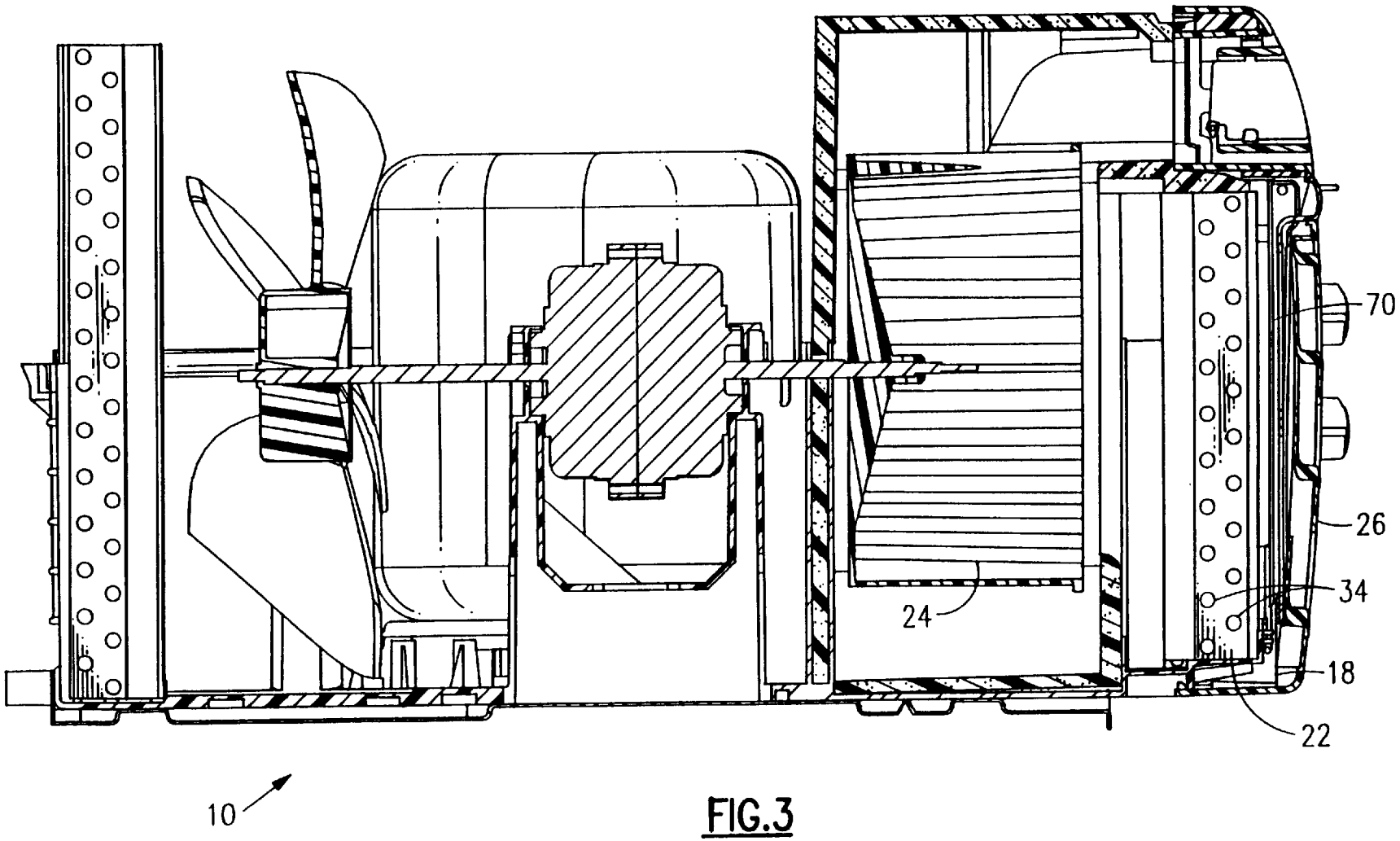
FIG. 3 is a side sectional view of the air conditioner of FIG. 1 with the top part of the outer housing removed therefrom.

The previously mentioned indoor grill 18 is adapted to be removably attached to the rectangular housing 12 as defined by the lower and upper housings 14 and 16, respectively. A cross-sectional view of the air conditioner unit showing the indoor grill 18 attached to the unit is shown in FIG. 3. In this figure it will be noted that the filter assembly 21 (again, to be described in detail hereinbelow) is mounted behind the intake louvers 26 of the indoor grill 18 and in spaced relationship with the front of the evaporator coil. As will be seen from the description of the invention which follows, the present invention prevents contact of the filter assembly 21 with the delicate fins 36 on the front of the evaporator coil as it is inserted and withdrawn from its operable position as illustrated in FIG. 3.

Figure 5:
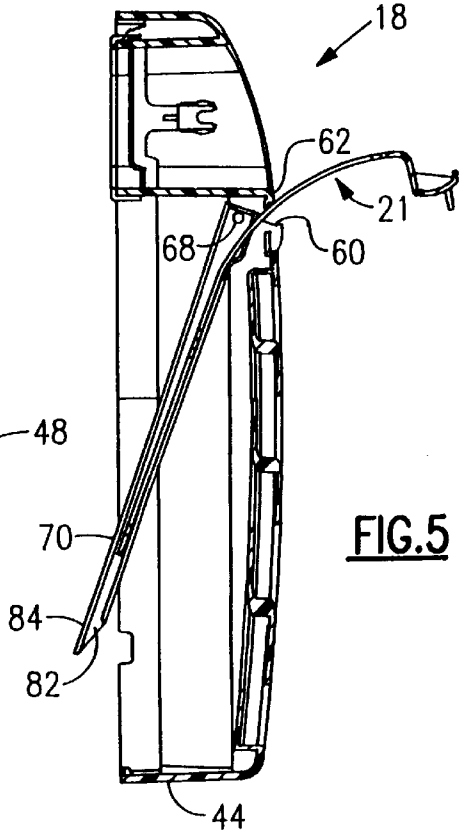
FIG. 5 is a sectional view taken along the lines 5—5 of FIG. 4.
Figure 4:
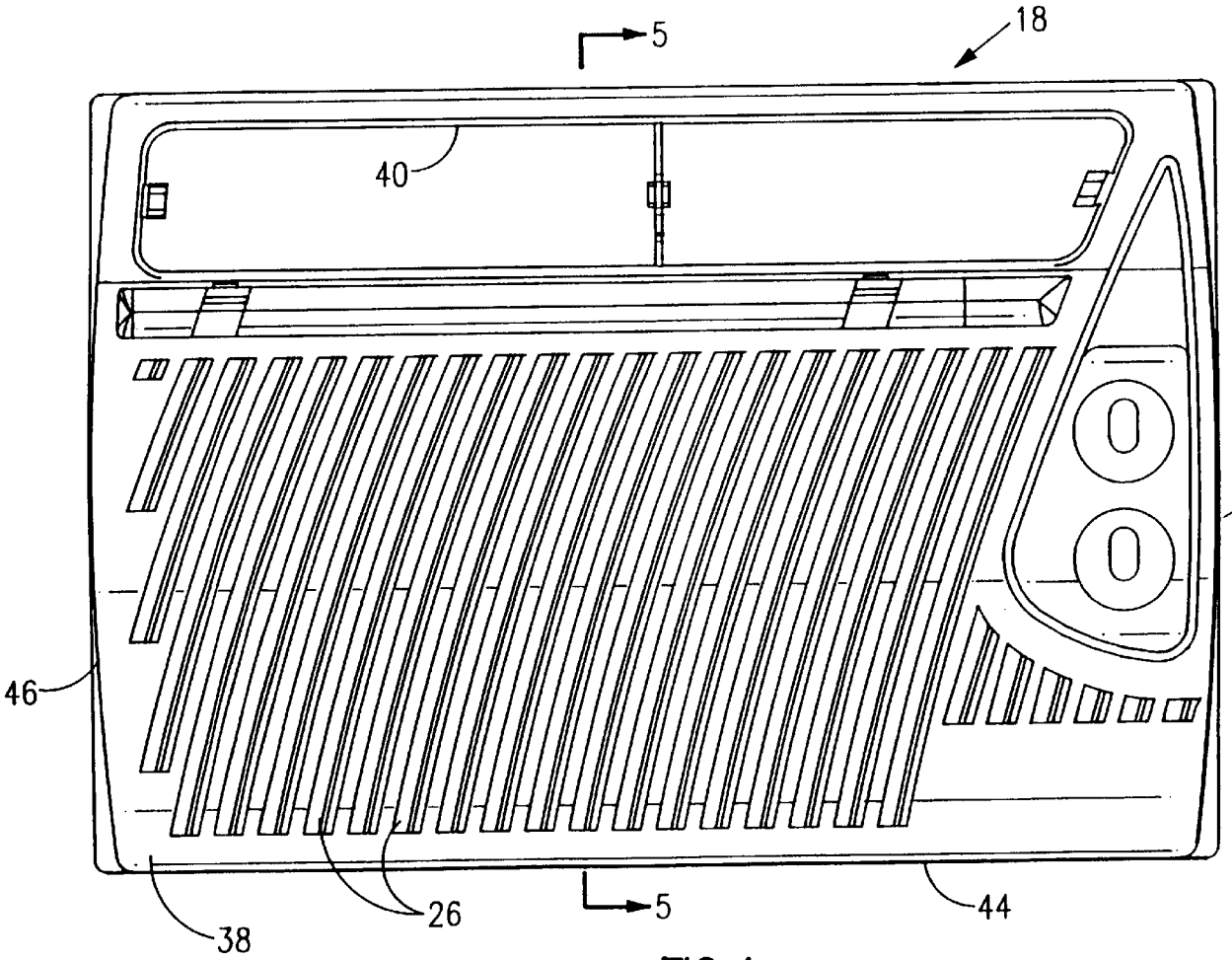
FIG. 4 is a front view of the front grill of the air conditioner of FIG. 1.
Figure 6:
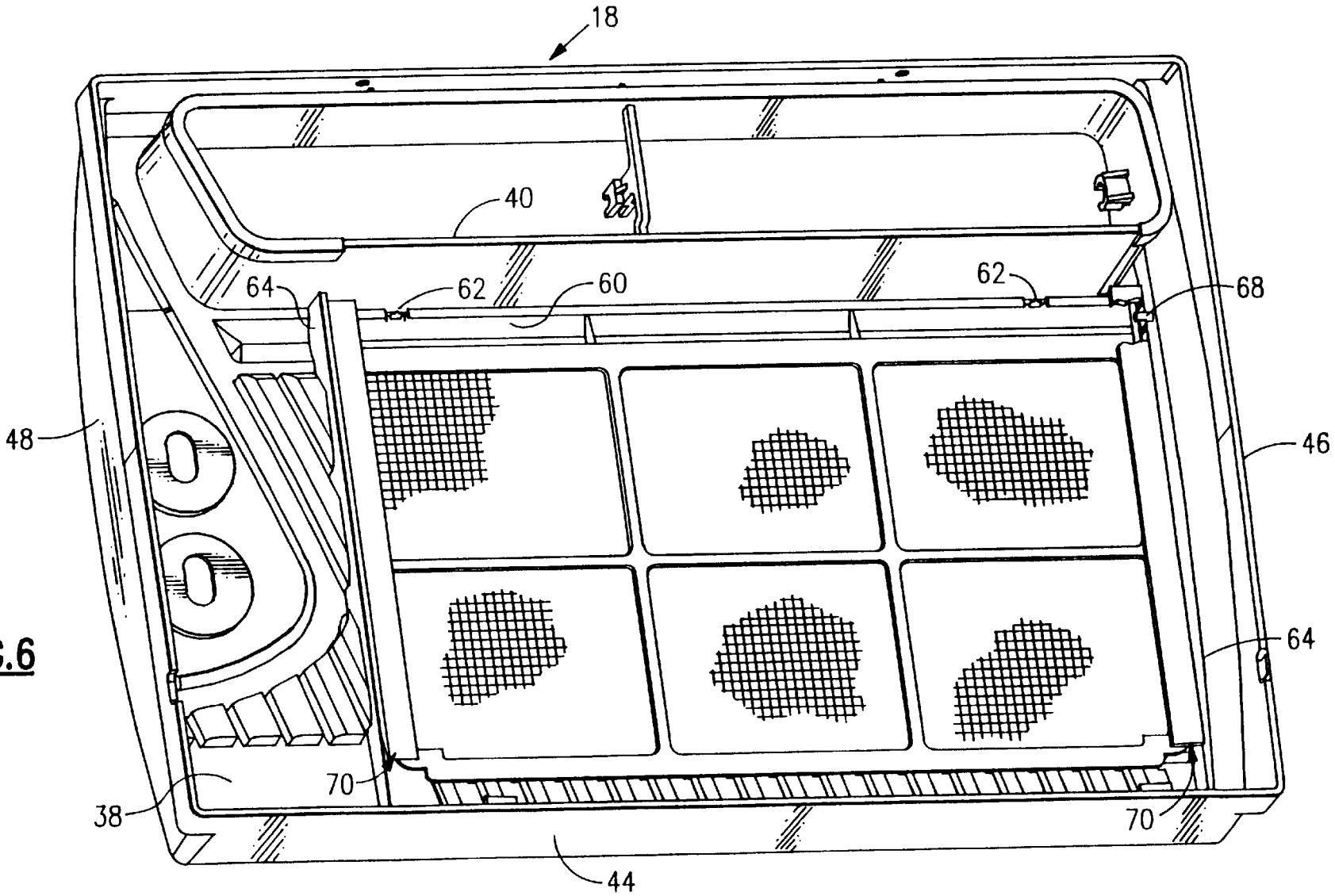
FIG. 6 is a back perspective view of the front grill with the filter installed therein.

FIGS. 4, 5 and 6 show the indoor grill 18 removed from the air conditioning unit 10. With reference now to those drawing figures, the front grill 18 includes a substantially planar front section 38, which includes previously mentioned inlet louvers 26 and an opening 40 in which the indoor air discharge assembly 28 is mounted. Extending from the planar front section are a top wall 42, a bottom wall 44 and a left and right-hand side walls 46 and 48, respectively. The top, bottom, left and right-hand walls cooperate to define a skirt element integrally formed and extending rearwardly from the planar front of the grill 18. It is should be understood that FIG. 6 illustrates the back of the inlet grill 18. The references to left and right-hand sides are based on viewing the air conditioning unit and grill 18 from the front as illustrated in FIG. 1 and, accordingly, references to left and right are reversed with respect to FIG. 6.

Figure 9:
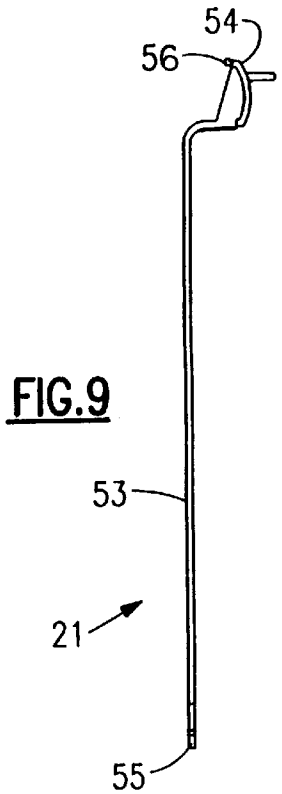
FIG. 9 is a side view of the filter of FIG. 7.
Figure 7:
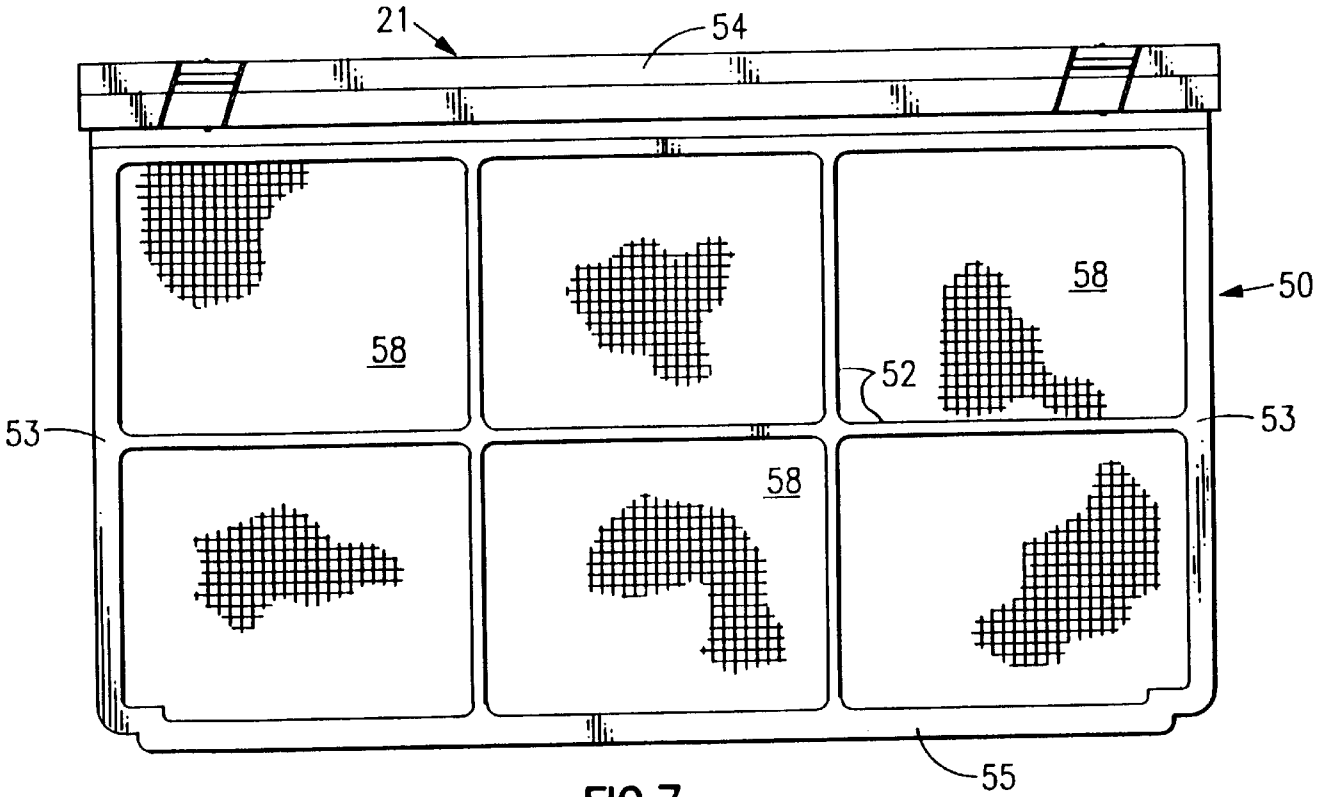
FIG. 7 is a front view of a filter for use with the present invention.
Figure 8:
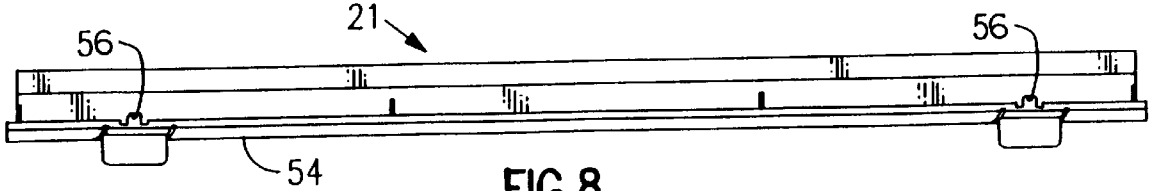
FIG. 8 is a top view of the filter of FIG. 7.

Looking first at FIGS. 7, 8 and 9, the filter assembly 21 includes a substantially rectangular frame 50 which defines a substantially planar grid-like section 52. The top of the filter frame 50 defines a horizontally extending forwardly facing wall 54 which has a pair of manually releasable snap-fit latch conformations 56 formed at opposite ends thereof. The filter frame 50 further includes a pair of laterally spaced sides 53 and a leading edge section 55 parallel to and spaced from the top wall 54. The filter frame 50 is preferably made from an unfilled copolymer polypropylene. A filter screen material 58 overlies and is integrally attached to the sections forming the grids 52. This screen is preferably a polypropylene material and is adapted to be cleaned by vacuuming and/or washing so that it may be reused for the lifetime of the unit.

Looking now at FIGS. 4, 5 and 6, the filter assembly 21 is adapted to be received in a horizontally extending opening 60 provided in the planar front wall 38 of the grill 18 at the upper end thereof above the inlet louvers 26. The slot 60 is sized to receive the top wall 54 of the filter therein when the filter is full installed. The slot is provided with mating latching structure 62 at the top side thereof, which is adapted to mate with the latches 56 provided on the top wall 54 when the filter is fully installed.

Looking now at FIGS. 5 and 6, a pair of upstanding parallel spaced wall sections are formed on the backside of the planar front wall 38 of the indoor grill 18. These walls extend on opposite sides of the air intake louvers 26 and extend from the opening 40, which is adapted to carry the air discharge assembly 28 to the inside of the bottom wall 44 of the grill 18. As best shown in FIGS. 5 and 6, an upstanding pivot pin 68 is molded into each of the spaced walls 64 at a location near the top of the filter receiving slot 60 and spaced inwardly from the plane of said slot 60.

Figure 10:
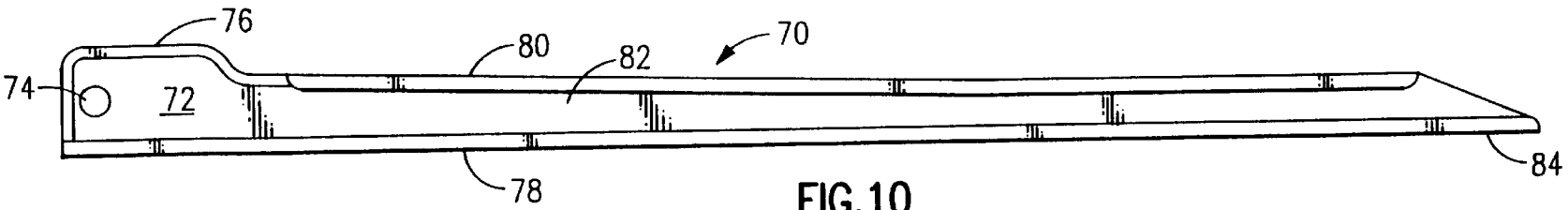
FIG. 10 is a side view of a filter guide channel according to the present invention.
Figure 11:
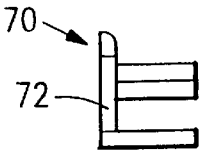
FIG. 11 is an end view of the filter guide channel of FIG. 10.
Figure 12:
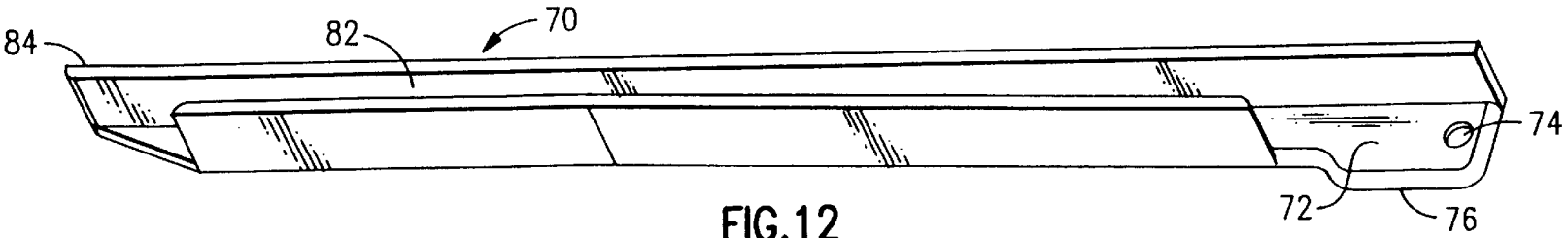
FIG. 12 is a perspective view of the filter guide channel of FIG. 10.

Pivotally mounted to each of the pins 68 is an elongated guide channel 70 shown in detail in FIGS. 10, 11 and 12. Each of the guide channels 70 comprises a side wall portion 72 having an opening 74 formed in an enlarged upper end 76 thereof. The openings are snap-fit onto one of the pivot pins 68 to allow free pivotal movement of the guide channel 70 about its engagement with its associated pivot pin 68.

Each of the guide channels 70 include a rear guide wall 78 and a front guide wall 80, which extend from opposite sides of the side wall 72 to form a filter receiving U-shaped channel 82. As best seen in FIGS. 10 and 11, the width of the side wall 72 tapers from the end adjacent the pivot opening 74 to the distal or lower end 84 to result in a narrowing of the channel 82 defined by the guide walls 78 and 80. As best seen in FIGS. 3, 5 and 6, the length of the rear guide wall 78 on each of the guide channels 70 is substantially the same as the overall length of a side 53 of the filter frame 50. As best seen in FIGS. 10 and 12, the front guide wall 80 originates at a location spaced from the enlarged end 76 of the side wall 72. As thus described, each of the guide channels 70 is adapted to be pivotally mounted as illustrated in FIGS. 5 and 6 in a manner such that it may pivot outwardly as best shown in FIG. 5 and pivot down to an installed position with the side wall 72 in confronting relation with the spaced wall 64 of the grill 18.

As so configured, when a filter assembly 21 is inserted into the slot 60, the leading edge 55 of the filter frame 50 will pass through the slot and directly engage the rear guide walls 78 of each of the guide channels 70 below the pivot pin 68. The insertion force of the filter will thereby cause each of the guide channels 70 to pivot outwardly as illustrated in an exaggerated fashion in FIG. 5 as the sides 53 of the filter frame 50 are received within their respective guide channels 70. Continued insertion of the filter will result in the sides 53 of the filter frame 50 being fully received within the guide channels and the filter, and guide channel 70 moving into the position illustrated in FIG. 6 as the top wall 54 of the filter moves into the slot 60 and the latches 56 are engaged with the mating structure 62 in the slot.

It should be appreciated that as the filter is being installed and the guide channels 70 are moving outwardly that the guide channels are adapted to engage front sections 86 and 88 of the left and right-hand tube sheets 30 and 32, respectively. As a result, no direct contact occurs between the filter assembly as it is installed within the indoor grill 18 and thus no interference with the insertion of the filter is caused by engagement with the fins 36 of the evaporator coil and accordingly no damage to the fragile fins will occur as a result of such contact.

What is claimed is:

1. An air conditioner of the type having an indoor section which includes a housing having an evaporator coil, having fins, mounted therein in a substantially vertical orientation, and an indoor grill adapted to be mounted to the housing in spaced relation to the evaporator coil, the grill including a front wall having a return air opening therein to admit return air to be conditioned into the evaporator coil, the front wall having an elongated opening adjacent to an edge thereof adapted to receive a filter for insertion and removal of the filter into the space between the indoor grill and the evaporator coil, the filter including a rectangular frame having a leading edge and a trailing edge, and laterally spaced edges interconnecting said leading and trailing edges, wherein the improvement comprises:

a filter guide structure for receiving said laterally spaced edges of said filter after said leading edge of said filter has passed through elongated opening for slideably guiding said filter along a path, the path preventing contact of said filter with said filter of said evaporator coil, said filter guide structure comprising:

a pair of elongated guide channels mounted, for pivotal movement about an end thereof, to pivot points located on the back side of said front wall at opposite ends of said elongated opening, said guide channels extending along opposite sides of said return air opening;

each of said guide channels having a rear guide at least coextensive with said pivotally mounted end and a front guide spaced from said rear guide and originating at a point spaced from said elongated opening;

whereby when said filter is inserted into said elongated slot, said leading edge engages said rear guide and the insertion force exerted on said filter results in pivotal movement of said guide channels away from the back side of said front wall to facilitate movement of said side edges of said filter into the space between said front and rear guides, and wherein complete insertion of said filter into said guide channels results in pivotal movement of said guide channels toward the back side of said front wall to thereby position said filter in the desired spaced relationship from said evaporator coil.

2. The apparatus of claim 1 wherein said evaporator coil includes vertically extending structural elements at opposite ends thereof each of said structured elements presenting a surface facing said back side of said front wall and spaced outwardly from said fins, wherein said pair of elongated guide channels are located so as to engage said surface of said structural elements when said filter is being inserted and withdrawn from said grill.

* * * * *